US010920763B2

(12) United States Patent
Poindexter et al.

(10) Patent No.: US 10,920,763 B2
(45) Date of Patent: Feb. 16, 2021

(54) DIAPHRAGM WITH EDGE SEAL

(71) Applicant: Wanner Engineering, Inc., Minneapolis, MN (US)

(72) Inventors: David Poindexter, Minneapolis, MN (US); Neil Taylor, Elk River, MN (US)

(73) Assignee: Wanner Engineering, Inc., Minneapolis, MN (US)

( * ) Notice: Subject to any disclaimer, the term of this patent is extended or adjusted under 35 U.S.C. 154(b) by 123 days.

(21) Appl. No.: 15/599,814

(22) Filed: May 19, 2017

(65) Prior Publication Data

US 2018/0058436 A1 Mar. 1, 2018

Related U.S. Application Data

(60) Provisional application No. 62/382,639, filed on Sep. 1, 2016.

(51) Int. Cl.

| | |
|---|---|
| ***F04B 43/00*** | (2006.01) |
| ***F04B 43/02*** | (2006.01) |
| ***F04B 43/06*** | (2006.01) |
| ***F04B 43/067*** | (2006.01) |
| ***F04B 13/00*** | (2006.01) |
| ***F04B 15/04*** | (2006.01) |

(52) U.S. Cl.

CPC ..... *F04B 43/009* (2013.01); *F04B 13/00* (2013.01); *F04B 15/04* (2013.01); *F04B 43/0054* (2013.01); *F04B 43/02* (2013.01); *F04B 43/06* (2013.01); *F04B 43/067* (2013.01)

(58) Field of Classification Search

CPC .. F04B 43/009; F04B 43/0054; F04B 43/067; F04B 43/02; F04B 43/06; F04B 13/00; F04B 15/04; G01M 3/28

USPC ..... 92/98 R

See application file for complete search history.

(56) References Cited

U.S. PATENT DOCUMENTS

| | | | | |
|---|---|---|---|---|
| 2,748,797 | A * | 6/1956 | Heizer | F16K 17/20 137/510 |
| 3,093,086 | A | 6/1963 | Altoz et al. | |
| 4,781,535 | A | 11/1988 | Frawley et al. | |
| 5,186,615 | A * | 2/1993 | Karliner | F04B 43/067 417/387 |

(Continued)

FOREIGN PATENT DOCUMENTS

| | | |
|---|---|---|
| CA | 2 445 585 A1 | 11/2002 |
| EP | 2 639 455 A1 | 9/2013 |

OTHER PUBLICATIONS

International Search Report and Written Opinion for Application No. PCT/US2017/049712 dated Dec. 12, 2017.

*Primary Examiner* — Charles G Freay

(74) *Attorney, Agent, or Firm* — Merchant & Gould P.C.

(57) ABSTRACT

A diaphragm (18) includes a disk-shaped center planar portion (40) and a first lip (42) and a second lip (44) on the outermost edge of the disk shaped portion (40) and extending transversely to the planar disk portion (40). The first lip (42) is on a first side of the diaphragm (18) and the second lip (44) is on an opposite side of the diaphragm (18). A mounting portion (38) extends outward from the center of the face of the planar portion (40) on the first side of the diaphragm (18). For metering pump applications pumping harsh fluids, the diaphragm (18) is typically made from a fluoropolymer and in particular may be made from polytetrafluoroethylene (PTFE).

12 Claims, 5 Drawing Sheets

(56) References Cited

U.S. PATENT DOCUMENTS

| | | | | |
|---|---|---|---|---|
| 5,476,368 | A * | 12/1995 | Rabenau | F04B 43/02 417/395 |
| 5,535,987 | A * | 7/1996 | Wlodarczyk | F16J 3/02 251/331 |
| 6,094,970 | A | 8/2000 | Sprenger et al. | |
| 6,582,206 | B2 | 6/2003 | Schluecker | |
| 6,941,853 | B2 * | 9/2005 | Hembree | F04B 43/0054 92/103 R |
| 7,201,097 | B2 * | 4/2007 | De Koning | F04B 43/0009 417/413.1 |
| 7,467,582 | B2 | 12/2008 | Hembree | |
| 7,905,172 | B2 * | 3/2011 | Ohrle | F04B 43/0054 417/395 |
| 10,697,447 | B2 * | 6/2020 | Wegener | F04B 43/021 |
| 2001/0050040 | A1 * | 12/2001 | Shimizu | F04B 43/0054 117/200 |
| 2015/0167853 | A1 * | 6/2015 | Obara | F16J 3/02 251/331 |
| 2015/0300491 | A1 * | 10/2015 | Teshima | F04B 43/0054 92/48 |
| 2016/0123313 | A1 * | 5/2016 | Simmons | F04B 9/133 417/53 |
| 2016/0230752 | A1 * | 8/2016 | Suzuki | F04B 43/0081 |

* cited by examiner

DIAPHRAGM WITH EDGE SEAL

BACKGROUND OF THE INVENTION

Field of the Invention

The present direction is directed to a system and method for sealing diaphragms and to a diaphragm pump with an improved diaphragm sealing system.

Prior Art

Diaphragm pumps are pumps in which the pumped fluid is displaced by a diaphragm. In hydraulically driven pumps, the diaphragm is deflected by hydraulic fluid pressure forced against the diaphragm. Such pumps have proven to provide a superior combination of value, efficiency and reliability. However, maintaining a proper seal and extending the life of the diaphragm are challenges with diaphragm pumps.

A further challenge with using diaphragms arises when harsh fluids that may be corrosive, caustic, or acidic must be pumped. Fluoropolymer materials including polytetrafluoroethylene (PTFE), commonly sold under the names TEFLON®, and GYLON® are often used for diaphragms in metering diaphragm pumps because of their chemical resistance. Such materials may resist harsh fluids, but may not have the flexibility and/or resiliency of many elastomeric materials. One of the challenges with using PTFE is its tendency to creep or cold flow over time. This characteristic makes sealing the outer periphery of the diaphragm difficult. The most common approach for sealing is to clamp a large area of the diaphragm so that the clamping pressure is low enough to limit creep. A drawback of this method is that it requires that the diaphragm have a large inactive area on the perimeter that ultimately increases the size of the pump.

These problems with clamping or deforming the perimeter are made worse with pumps that utilize multiple layer diaphragms for leak detection. In these configurations, steps must be taken to limit the crushing of the separation layers. An example of a complex layered vacuum path is described in U.S. Pat. No. 6,094,970.

Another approach that has been used to reduce the deformation force and area is the application of self-energizing seals. An example of a self-energizing seal is shown in U.S. Pat. No. 6,582,206. These seals include elastomeric O-rings or cup seals that exert pressure on the surface to seal when fluid pressure is applied. These seals rely on some amount of initial preload that comes from the deflection of the elastic compound they are made from. In the case of pumps utilizing PTFE diaphragms, the fluids being pumped are often not compatible with elastomer compounds so the seals must also be made of PTFE. Again, the cold flow of the PTFE seals over time relaxes the initial sealing force of the seal, so leaks can often occur especially on startup.

An approach utilizing a ring formed in the diaphragm is shown in U.S. Pat. No. 4,781,535. However, the flange formed into the diaphragm in not pressure energized and the patent does not disclose pressurizing for forming an additional seal.

It can be seen then that a new and improved diaphragm pump including a diaphragm with an improved sealing arrangement at it edge is required. Such an improved sealing arrangement should be resistant to harsh chemicals while also providing for a reliable seal, even on startup, and extended life for the diaphragm element. In addition, such a system should be simple to manufacture and install without increasing the size of the pump. The present invention addresses these, as well as others associated with diaphragm pumps and diaphragm sealing arrangements.

SUMMARY OF THE INVENTION

The present invention is directed to a diaphragm arrangement for a diaphragm pump and in particular to a diaphragm arrangement with lip elements at a periphery of the diaphragm for sealing around the edge of the diaphragm.

In one embodiment, a diaphragm assembly includes a monolithic diaphragm element having a disk shaped portion having a first face and an opposed second face. A first edge portion extends substantially transverse to the first face of the disk shaped portion and a second edge portion extending substantially transverse to an opposed second face of the disk shaped portion. A pump frame is configured to support and seal a periphery of the diaphragm member. The frame includes first and second clamping faces engaging the first and second faces of the diaphragm member and defining a cavity configured to receive the first edge portion and the second edge portion. A first sealing element such as an O-ring engages the first face of the disk shaped portion, a radially inner portion of the first edge portion and a wall of the frame. A second O-ring sealing element engages the second face of the disk shaped portion, a radially inner portion of the second edge portion and a wall of the frame. The diaphragm member may be a monolithic fluoropolymer element and in particular made of polytetrafluoroethylene.

In operation, on each pressure stroke of the pump, pressure increases in both the hydraulic chamber and the pumping chamber. The increasing pressure forces the O-rings and outward to push on the lips extending from each face of the diaphragm. As force is applied to the sealing lips, the lips are forced against respective first and second groove walls. This sealing occurs even if there is some leakage past a respective O-ring. When the first and second lips are forced against the groove walls, high contact pressure is generated that resists leakage past the contacting surfaces to an atmospheric leak path. Moreover, as the pressure in the pumping and hydraulic chambers increases, the contact pressure of each of the sealing lips against the respective groove wall also increases. This creates a "self-energizing" seal to provide a sealing force. In addition, by the lips being forced tightly against the respective walls, any potential gap that the O-ring could extrude through is closed, having the same effect as an anti-extrusion backup ring.

In a further embodiment, a double diaphragm arrangement is used in diaphragm pumps for leak detection. In such pumps, a first diaphragm and a second diaphragm separated by and attached to a porous mesh material. The first diaphragm faces the hydraulic chamber and has a single lip that extends from the face of the diaphragm and seals against a groove wall. The second diaphragm is on the pumping chamber side and has a lip extending from the opposite face of the diaphragm and seals against a groove wall. The double diaphragm arrangement also includes first and second O-rings providing a secondary seal. The diaphragms may be made of the same or different materials. However, the second diaphragm facing the pumping chamber may need to be made of PTFE as it may come into contact with harsh fluids being pumped.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring now to the drawings, wherein like reference numerals and letters indicate corresponding structure throughout the several views.

DETAILED DESCRIPTION OF THE PREFERRED EMBODIMENT

Figure 1:
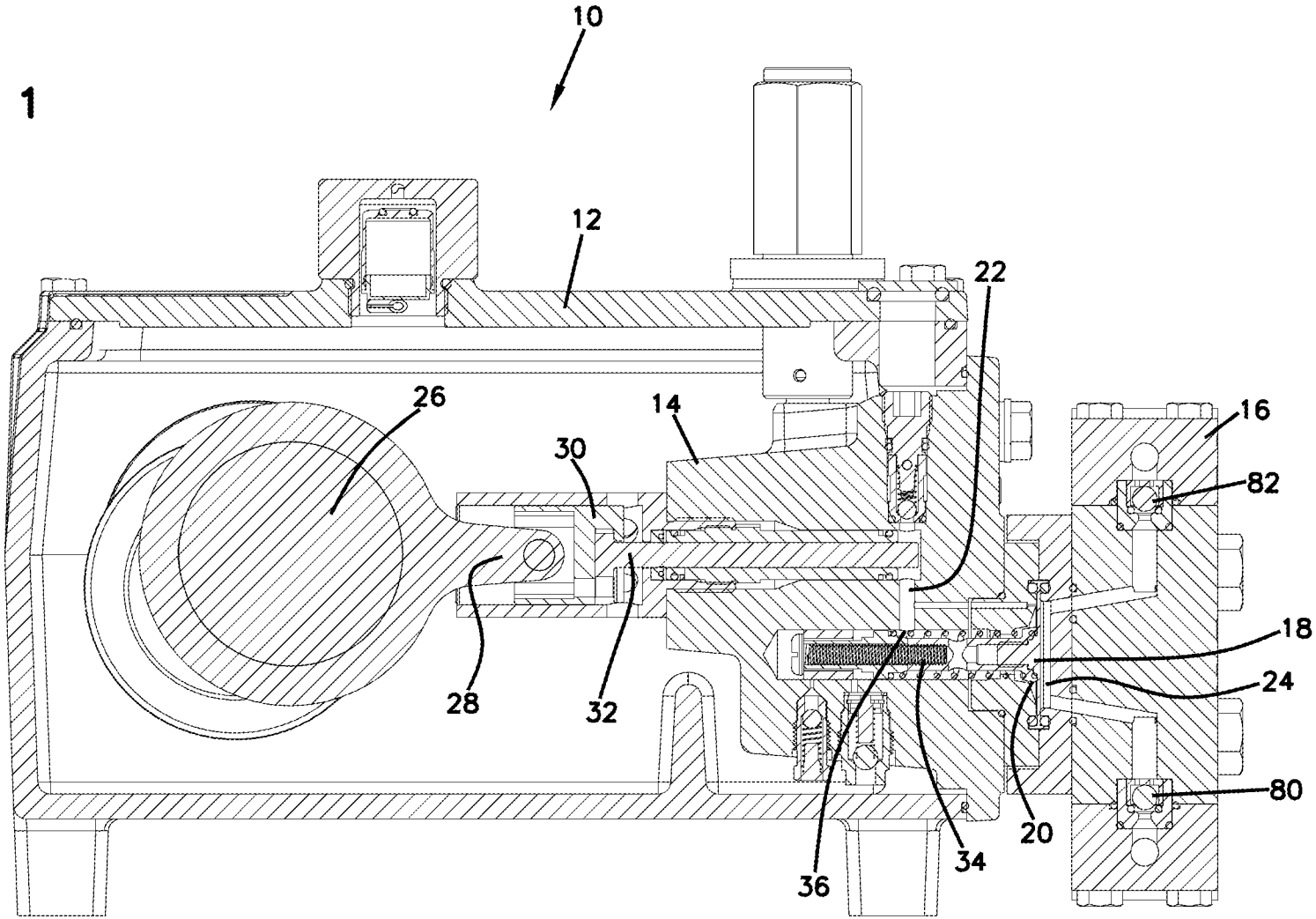
FIG. 1 is a side sectional view of a diaphragm pump according to the principles of the present invention.
Figure 3:
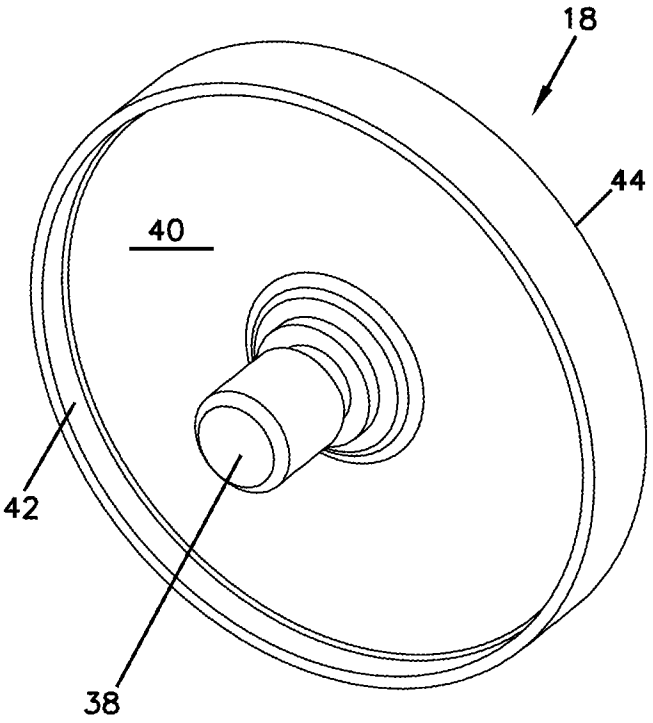
FIG. 3 is a rear perspective view of the diaphragm shown in FIG. 2.
Figure 2:
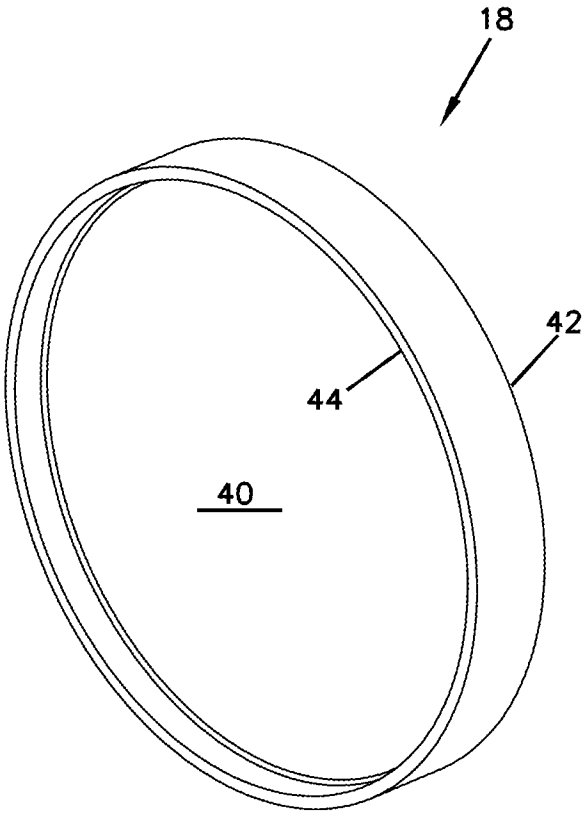
FIG. 2 is a front perspective view of a diaphragm for the diaphragm pump shown in FIG. 1.
Figure 5:
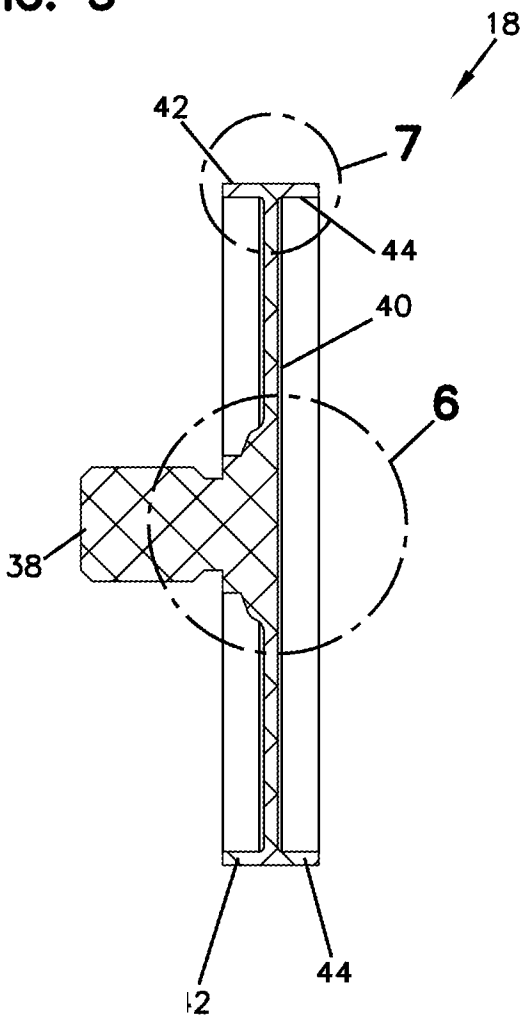
FIG. 5 is a side section view of the diaphragm taken along line 5-5 of FIG. 4.
Figure 4:
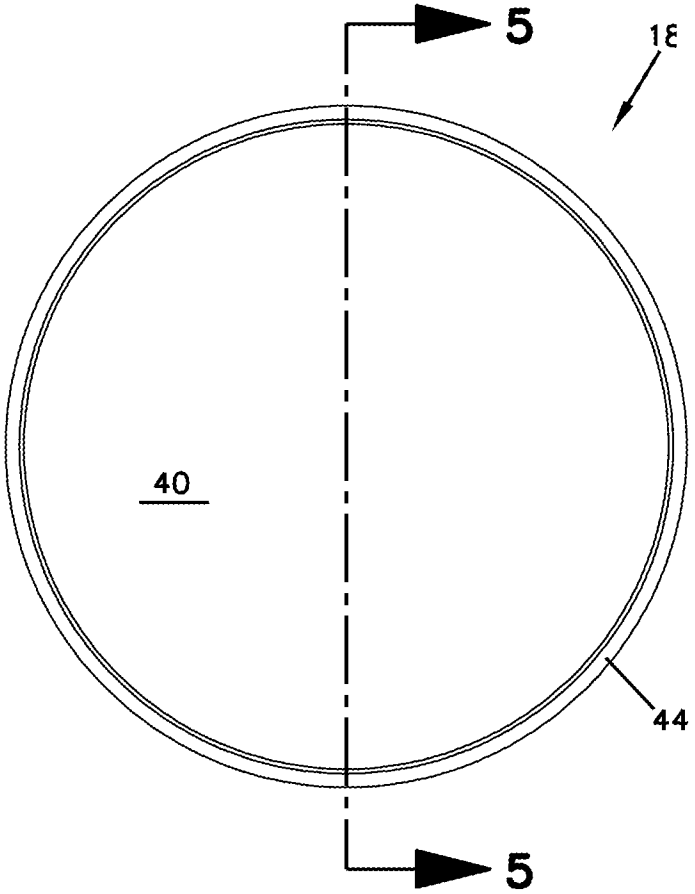
FIG. 4 is a front elevational view of a diaphragm for the diaphragm shown in FIG. 2.
Figure 6:
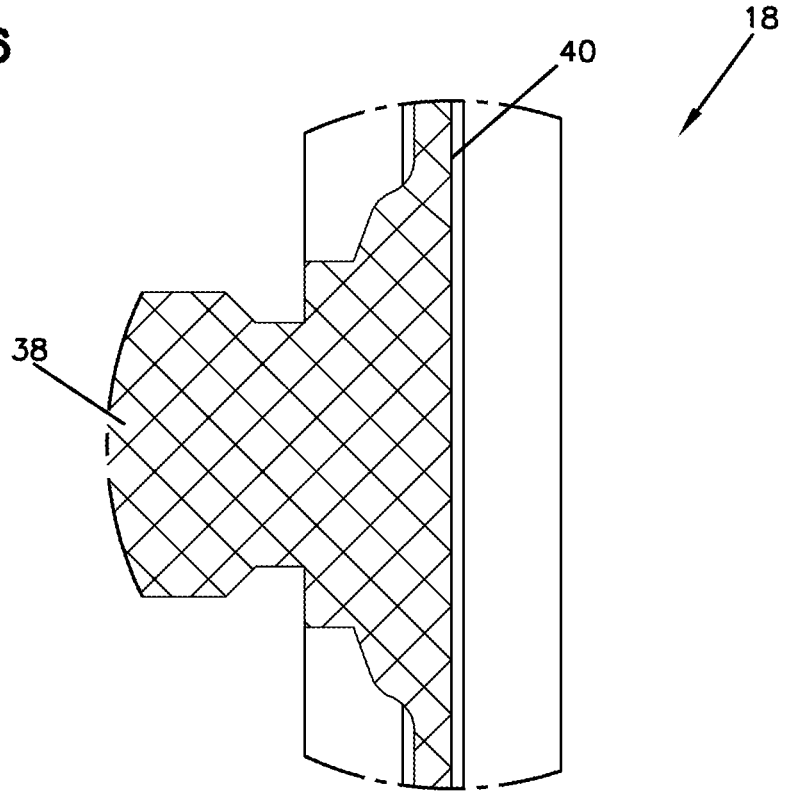
FIG. 6 is a detail sectional view of the piston mounting portion of the diaphragm shown in FIG. 5.
Figure 7:
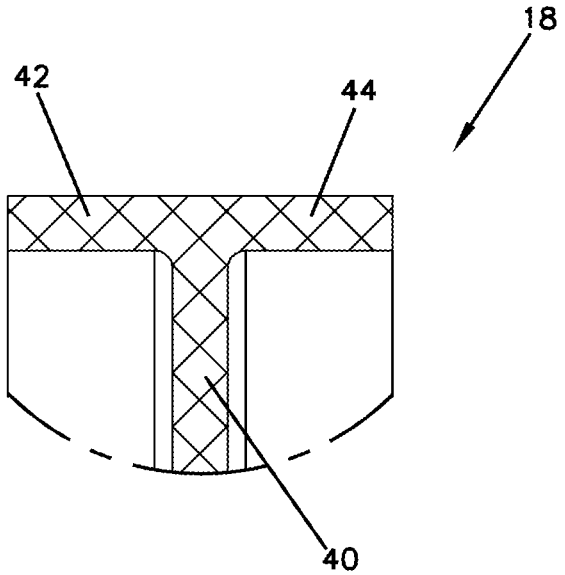
FIG. 7 is a detail view of an edge of the diaphragm shown in FIG. 5.

Referring now to the drawings and in particular to FIG. 1, there is shown a diaphragm pump, generally designated (10).

The pump (10) includes a housing (12) also functioning as a crankcase, a piston housing (14), and a manifold (16). The piston housing (14) defines a transfer or hydraulic chamber (20), and a plunger chamber (22). The manifold (16) defines a pumping chamber (24) and includes inlet valves (80) and outlet valves (82).

A crankshaft (26), a connecting rod (28), and a slider (30) are positioned within the crankcase (12). The slider (30) is coupled to a plunger (32) positioned within the plunger chamber (22). The transfer and plunger chambers (20), (22) are in fluid communication with each other such that fluid drawn into or forced out of the plunger chamber (22) draws the diaphragm (18) into a retracted position or forces the diaphragm into an extended position to achieve a pumping action.

A diaphragm rod (34) extends from the diaphragm (18) through the transfer chamber (20). A spring (36) is positioned co-axially with the rod (34) to exert a biasing force on the diaphragm (18) in a rearward direction to help maintain a higher pressure condition in the transfer chamber (20) than in the pumping chamber (24).

Referring to FIGS. 2-7, in a first embodiment, the diaphragm (18) is a monolithic element and includes a disk-shaped center planar portion (40) and a first lip (42) and a second lip (44) on the outermost edge of the disk shaped portion (40) and extending transversely to the planar disk portion (40). The first lip (42) is on the hydraulic chamber side of the diaphragm (18) and the second lip (44) is on the pumping chamber side of the diaphragm (18). A mounting portion (38) extends outward from the center of the face of the planar portion (40) on the hydraulic chamber side of the diaphragm (18). For metering pump applications pumping harsh fluids, the diaphragm (18) is typically made from a fluoropolymer and in particular may be made from polytetrafluoroethylene (PTFE), commonly marketed as TEFLON®, or may be made from GYLON®. The material used depends on whether the fluid being pumped is harsh and requires special materials that will not degrade if contacted by the fluid.

Figure 8:
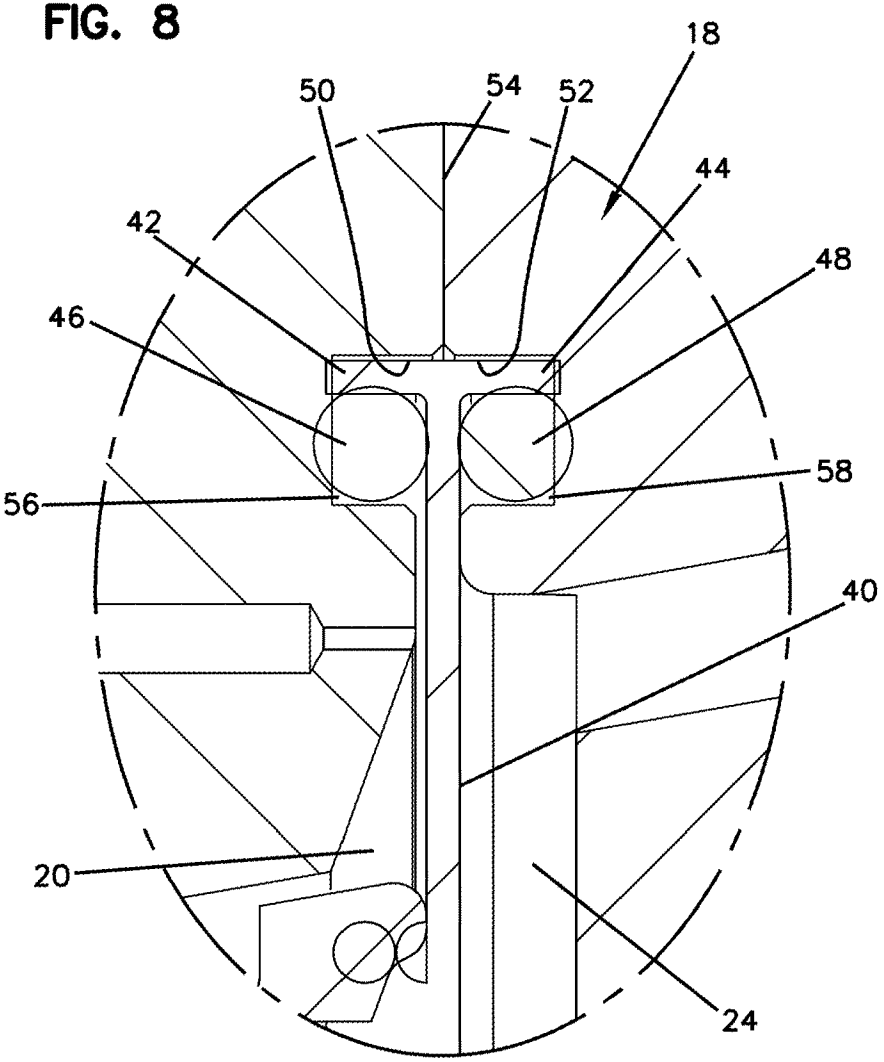
FIG. 8 is a sectional view of the edge of the diaphragm mounted in the diaphragm pump.

As shown in FIG. 8, adjacent to the lips are two associated O-rings. A first O-ring (46) on the hydraulic chamber side is preferably made of an elastomer compatible with the hydraulic fluid. A second O-ring (48) is on the pumping chamber side and is exposed to the same fluid as the fluid side of the diaphragm (18). For harsh fluid uses, the second O-ring (48) is therefore typically made from PTFE, such as TEFLON®, or GYLON® or is PTFE coated. Two sections of the housing (14) clamp against the opposed faces of the planar portion (40). The housing (14) defines a first recess or cavity (56) configured to receive the first lip (42) and the first O-ring (46) and a second recess or cavity configured to receive the second lip (44) and the second O-ring (48). The first cavity (56) includes a groove wall (50) engaged by the first lip (42) and the second cavity (58) includes a groove wall (52) engaged by the second lip (44).

Figure 9:
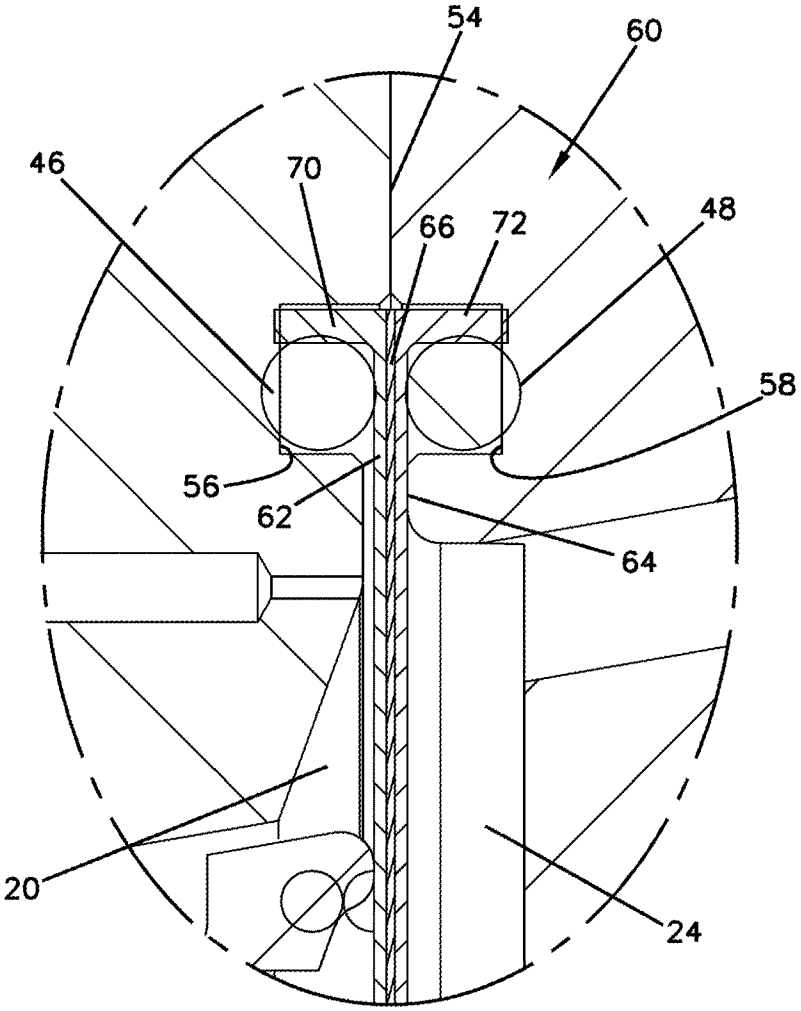
FIG. 9 is a sectional view of the edge of an alternate embodiment of the diaphragm mounted in the diaphragm pump.

Referring now to FIG. 9, in a second embodiment, a double diaphragm arrangement (60) is used in diaphragm pumps for leak detection. In this embodiment, the pump (10) uses a first diaphragm (62) and a second diaphragm (64) attached to and separated by a porous mesh material (66). The first diaphragm (62) faces the hydraulic chamber (20) and has a single lip (70) that seals against the groove wall (50). The second diaphragm (64) is on the pumping chamber side and has a single lip (72) that seals against the groove wall (52). The double diaphragm arrangement also includes the first O-ring (46) and the second O-ring (48) as with diaphragm (10). The diaphragms (62), (64) may be made of the same or different materials. However, the diaphragm (64) may need to be made of PTFE as the diaphragm (64) may come into contact with harsh fluids being pumped.

In operation, on each pressure stroke of the pump (10), pressure increases in both the hydraulic chamber (20) and the pumping chamber (24). Increasing pressure forces the O-rings (46) and (48) outward to push on the lips (42) and (44) respectively. As force is applied to the sealing lips (42) and (44), the lips (42) and (44) are forced against the respective first groove wall (50) and the second groove wall 52. This deformation will occur even if there is some leakage past an O-ring (46) or (48). When the first and second lips (42) and (44) are forced against the groove walls (50) and (52) high contact pressure is generated that resists leakage past the contacting surfaces to the atmospheric leak path (54). As the pressure in the pumping and hydraulic chambers (24, 20) increases, the contact pressure of each of the lips (42) and (44) against the respective walls (50) and (52) also increases. This creates a "self-energizing" seal. In addition, by the lips (42) and (44) being forced tightly against the respective walls (50) and 52, any gap that an O-ring could extrude through is closed, having the same effect as an anti-extrusion backup ring.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A diaphragm assembly comprising:

a diaphragm member comprising:

a disk shaped portion having a first face and an opposed second face;

a first edge portion extending substantially transverse to the first face of the disk shaped portion;

a second edge portion extending substantially transverse to the second face of the disk shaped portion;

a frame configured to support and seal a periphery of the diaphragm member, the frame having first and second clamping faces engaging the first and second faces of the diaphragm member and defining a cavity configured to receive the first edge portion and the second edge portion;

a first sealing element engaging the first face of the disk shaped portion, a radially inner portion of the first edge portion and the frame;

a second sealing element engaging the second face of the disk shaped portion, a radially inner portion of the second edge portion and the frame.

2. A diaphragm assembly according to claim 1, wherein each of the first sealing element and the second sealing element comprises an O-ring.

3. A diaphragm assembly according to claim 1, wherein the diaphragm member comprises a monolithic fluoropolymer element.

4. A diaphragm assembly according to claim 1, wherein the diaphragm member comprises polytetrafluoroethylene.

5. A diaphragm assembly according to claim 1, wherein the diaphragm member comprises a monolithic element.

6. A diaphragm assembly according to claim 1, wherein the diaphragm member comprises a monolithic polytetrafluoroethylene element.

7. A diaphragm assembly according to claim 1, wherein the diaphragm member comprises a monolithic fluoropolymer element.

8. A diaphragm pump comprising:

a housing having a pumping chamber containing fluid to be pumped;

a cylinder;

a piston sliding in a reciprocating motion in the cylinder;

a diaphragm assembly coupled to the piston comprising:

a diaphragm member in fluid communication with the pumping chamber, the diaphragm member comprising:

a disk shaped portion having a first face and an opposed second face;

a first edge portion extending substantially transverse to the first face of the disk shaped portion;

a second edge portion extending substantially transverse to the second face of the disk shaped portion;

a first sealing element engaging the first face of the disk shaped portion and a radially inner portion of the first edge portion;

a second sealing element engaging the second face of the disk shaped portion and a radially inner portion of the second edge portion;

the housing being configured to support and seal a periphery of the diaphragm member, the housing having first and second clamping faces engaging the first and second faces of the diaphragm member and defining a cavity configured to receive the first edge portion and the first sealing element and the second edge portion and the second sealing element.

9. A diaphragm pump according to claim 8, wherein the diaphragm member comprises polytetrafluoroethylene.

10. A diaphragm pump according to claim 8, wherein the diaphragm member comprises a monolithic element.

11. A diaphragm pump according to claim 8, wherein the diaphragm member comprises a monolithic polytetrafluoroethylene element.

12. A diaphragm pump according to claim 8, wherein each of the first sealing element and the second sealing element comprises an O-ring.

* * * * *